US006773571B1

(12) United States Patent
Mayer et al.

(10) Patent No.: US 6,773,571 B1
(45) Date of Patent: Aug. 10, 2004

(54) METHOD AND APPARATUS FOR UNIFORM ELECTROPLATING OF THIN METAL SEEDED WAFERS USING MULTIPLE SEGMENTED VIRTUAL ANODE SOURCES

(75) Inventors: Steven T. Mayer, Lake Oswego, OR (US); Evan E. Patton, Portland, OR (US); Brian Paul Blackman, Woodburn, OR (US); Jonathan D. Reid, Sherwood, OR (US); Thomas Anand Ponnuswamy, Tualatin, OR (US); Harold D. Perry, Eugene, OR (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

(21) Appl. No.: 10/154,082

(22) Filed: May 22, 2002

Related U.S. Application Data

(60) Provisional application No. 60/302,111, filed on Jun. 28, 2001.

(51) Int. Cl.[7] ..... C25D 5/00; C25B 9/00

(52) U.S. Cl. ..... 205/96; 204/232; 204/242; 204/272; 204/275.1; 204/280; 204/286.1; 205/123; 205/148; 205/157; 205/291; 205/292

(58) Field of Search ..... 205/96, 123, 148, 205/157, 291, 292; 204/232, 242, 272, 275.1, 280, 286.1

(56) References Cited

U.S. PATENT DOCUMENTS

| | | | | |
|---|---|---|---|---|
| 3,706,651 A | | 12/1972 | Leland | 204/218 |
| 4,082,638 A | | 4/1978 | Jumer | 204/213 |
| 4,604,177 A | | 8/1986 | Sivilotti | 204/244 |
| 4,604,178 A | | 8/1986 | Flegener et al. | 204/288.5 |
| 4,828,654 A | | 5/1989 | Reed | 205/97 |
| 5,146,136 A | | 9/1992 | Ogura et al. | 315/39.69 |
| 5,156,730 A | | 10/1992 | Bhatt et al. | 205/118 |
| 5,217,586 A | | 6/1993 | Datta et al. | 205/666 |
| 5,316,642 A | | 5/1994 | Young, Jr. et al. | 204/198 |
| 6,193,860 B1 | | 2/2001 | Weling | 204/230.2 |
| 6,391,166 B1 | | 5/2002 | Wang | |
| 6,395,152 B1 | | 5/2002 | Wang | |
| 6,402,923 B1 | * | 6/2002 | Mayer et al. | 205/96 |
| 6,497,801 B1 | | 12/2002 | Woodruff et al. | 204/230.2 |

FOREIGN PATENT DOCUMENTS

| | | |
|---|---|---|
| EP | 0037325 A1 | 10/1981 |
| JP | 59-162298 | 9/1984 |
| JP | 09-53197 | 2/1997 |
| JP | 2001316887 | 11/2001 |
| WO | WO/9941434 | 8/1999 |

OTHER PUBLICATIONS

Mayer et al., "Electrochemical Treatment of Integrated Circuit Substrates Using Concentric Anodes and Variable Field Shaping Elements," U.S. patent application No. 10/116,077, filed: Apr. 4, 2002, 82 pages.

Woodruff et al., "Electroplating Apparatus with Segmented Anode Array," U.S. Publication No. 2003/0102210, Published: Jun. 5, 2003, 13 pages.

* cited by examiner

*Primary Examiner*—Robert R. Koehler
(74) *Attorney, Agent, or Firm*—Beyer Weaver & Thomas, LLP

(57) ABSTRACT

The present invention pertains to methods and apparatus for electroplating a substantially uniform layer of a metal onto a work piece having a seed layer thereon. The total current of a plating cell is distributed among a plurality of anodes in the plating cell in order to tailor the current distribution in the plating electrolyte to compensate for resistance and voltage variation across a work piece due to the seed layer. Focusing elements are used to create "virtual anodes" in proximity to the plating surface of the work piece to further control the current distribution in the electrolyte during plating.

45 Claims, 7 Drawing Sheets

METHOD AND APPARATUS FOR UNIFORM ELECTROPLATING OF THIN METAL SEEDED WAFERS USING MULTIPLE SEGMENTED VIRTUAL ANODE SOURCES

CROSS REFERENCE TO RELATED APPLICATIONS

This application claims priority under 35 USC 119(e) from U.S. Provisional Application No. 60/302,111, having Steve Mayer et al. as inventors, filed Jun. 28, 2001, and titled "Method and Apparatus for Uniform Electroplating of Thin Metal Seeded Wafers Using Multiple Segmented Virtual Anode Sources," which is incorporated herein by reference for all purposes. This application is related to U.S. patent application Ser. No. 10/116,077 , now allowed, having Steve Mayer et al. as inventors, filed Apr. 4, 2002, and titled "Electrochemical Treatment of Integrated Circuit Substrates Using Concentric Anodes and Variable Field Shaping Elements," which is incorporated herein by reference for all purposes.

FIELD OF THE INVENTION

The present invention pertains to methods and apparatus for electroplating metal onto a work piece. More specifically, the invention pertains to methods and apparatus for controlling the electrical resistance and current flow characteristics in an electrolyte environment encountered by the work piece during electroplating.

BACKGROUND OF THE INVENTION

The first generation of integrated circuits that used copper as the IC level interconnecting technology was introduced by IBM in 1997. The transition from aluminum to copper required a change in process "architecture" (to damascene and dual-damascene) as well as new process technologies. Two processes used in producing copper damascene circuits are the formation of a "seed-" or "strike-" layer, which is then used as a base layer onto which copper is electroplated ("electrofill").

A seed layer is typically a thin conductive metal (e.g. copper) film (conventionally about 1250 Å thick). The seed layer is separated from the insulating dielectric (e.g silicon oxide) by a barrier layer so that copper inlay thereon does not diffuse into the dilelectric. The seed layer carries an electrical plating current from the edge of the wafer (where electrical contact is typically made) to all trench and via structures located across the wafer surface. Ideally, the seed layer should be conformal and continuous over and into all such features and have minimal closure or "necking" at the top of the embedded features. The demand for increasingly smaller device features, there is a concomitant need for correspondingly thinner seed layers to prevent necking. It is anticipated that in the near future, seed thickness will decrease to 500 Å and may eventually decrease to as little as 100 Å.

As seed layer thickness decreases, the ability to electroplate with a high degree of uniformity becomes more problematic. One problem is the resistance of the seed layer. The use of larger wafer diameters, exacerbates this problem, because the plating current must traverse an even larger distance through the seed layer. The seed layer initially has a significant resistance radially from the edge to the center of the wafer because the seed layer is initially very thin. This resistance causes a corresponding potential drop from the edge where electrical contact is made to the center of the wafer. These effects are reported in L. A. Gochberg, "Modeling of Uniformity and 300-mm Scale-up in a Copper Electroplating Tool", *Proceedings of the Electrochemical Society* (Fall 1999, Honolulu Hi.); and E. K. Broadbent, E. J. Mclnerney, L. C. Gochberg, and R. L. Jackson, "Experimental and Analytical Study of Seed Layer Resistance for Copper Damascene Electroplating", *Vac. Sci. & Technol.* B17, 2584 (November/December 1999). Thus, the seed layer has a non-uniform initial potential that is more negative at the edge of the wafer. The associated deposition rate tends to be greater at the wafer edge relative to the interior of the wafer. This effect is known as the "terminal effect." Terminal effect resistance losses are common, and they vary with time during a plating process.

Another variable that adds to the complexity of the issue is non-uniformity in the seed layer across a wafer surface. Seed layer non-uniformity imparts resistance variation across the wafer. Yet another variable is feature aspect ratio and feature density. Having a high-density of features, especially those with high aspect ratios, causes significant variation in seed layer resistance across a wafer. These issues demand improvements in hardware and processes to maintain uniform plating when thin seed layers are used to initiate electroplating. Asymmetrical shielding elements have been examined as a way to change (tailor) the composite plating process uniformity. The change in plating current was estimated as the time averaged exposure that a rotating wafer would "see" with a mask of a certain shape and size covering the part during a rotational period. This work is described in U.S. Pat. No. 6,027,631, entitled "Electroplating System with Shields for Various Thickness Profile of Deposited Layer", by Broadbent, et al., which is herein incorporated by reference for all purposes.

Jorne et al., U.S. Pat. No. 6,132,587, describes various methods of mitigating the terminal effect. Methods to improve the uniformity of metal electroplating over the entire wafer included: increasing the resistance of the electrolyte, increasing the distance between the wafer and the anode, increasing the thickness of the seed layer, increasing the ionic resistance of a porous separator placed between the wafer and the anode, placement of a rotating distributor in front of the wafer, and establishing contacts at the center of the wafer. As well, they describe a method that uses a "rotating distributor jet" that directs varying amounts of electrolyte flow to different radii of a wafer. This method is not particularly useful because plating conditions (flow rate, replenishment of additives, etc.) vary locally and therefore create a convolution between electrofilling and uniformity. Additionally, no simple means of varying the uniformity with respect to process time is presented.

While the approaches discussed above have proven useful, they suffer a number of potential limitations. Such limitations include the inability to continuously change (throughout a plating process) the resistance compensation, the high cost of implementation, and mechanical limitations (e.g. a large number of moving part in a corrosive bath, material compatibility limitations, and reliability).

What is needed therefore, are improved apparatus and methods for uniform electroplating onto thin-metal seeded wafers, particularly wafers with large diameters (e.g. 300 mm).

SUMMARY OF THE INVENTION

The present invention pertains to methods and apparatus for electroplating a substantially uniform layer of a metal onto a work piece having a seed layer thereon. The total current of a plating cell is distributed among a plurality of anodes in the plating cell in order to tailor the current distribution in the plating electrolyte to compensate for resistance and voltage variation across a work piece due to the seed layer. Focusing elements are used to create "virtual anodes" in proximity to the plating surface of the work piece to further control the current distribution in the electrolyte during plating.

One aspect of the invention is a method for electroplating a substantially uniform layer of a metal onto a work piece having a seed layer thereon. Such methods may be characterized by the following operations: (a) immersing at least that portion of the work piece having the seed layer thereon in an electrolyte, the electrolyte containing ions of the metal; and (b) passing a current between the seed layer and a plurality of anodes whereby the current is distributed among the plurality of anodes such that, for any instance in time during plating, the metal is deposited substantially uniformly onto the entire surface area of the seed layer.

Semiconductor wafers are one such work piece. Preferably the entire surface area of the seed layer consists of an inner and an outer region. In one example, the inner region is a circular surface area, the center of the circular surface area coincident with the center of the wafer. The outer region is an annular surface area defined by an outer circle, substantially coincident with the outermost edge of the wafer, and an inner circle of the same diameter as the inner region. Preferably, the inner region includes between about 15 and 25 percent of the surface area of the seed layer, the outer region covering the remainder of the surface area of the seed layer.

In one example, distributing the current between a plurality of anodes means distributing the current between an inner anode, proximate to the inner region, and an outer anode, proximate to the outer region. For example, when electroplating metal onto a wafer with a thin seed layer (where electrical contact is made at the wafer edge), the plating current is distributed between the inner and outer anode to compensate for the terminal effect. For example, a larger percentage of the total plating current of a cell is applied to the inner anode in order to overcome initial higher electrical resistance levels in the inner region (vs. in the outer region). As the plated layer thickens and terminal effect is ameliorated, the relative ratio of current applied to the inner vs. the outer anode is decreased in order to more evenly distribute the current in the electrolyte proximate the inner vs. outer regions. Thus according to the above method, (b) includes: i. distributing the current between a first anode, the first anode proximate an inner region of the seed layer, and a second anode, the second anode proximate an outer region of the seed layer, such that the inner region is exposed to a larger fraction of the resultant current per unit area than the outer region during an initial stage of plating; and, ii. redistributing the current between the first and second anodes toward a distribution that corresponds substantially to the ratio of the work surface areas of the first and second anode or work surface areas of any corresponding virtual anodes (described below) for each of the first and the second anodes. Preferably the work surface areas of each of the first and second anodes and/or the work surfaces of any corresponding virtual anodes for each of the first and the second anodes correspond substantially to the areas of the inner and outer regions of the seed layer, respectively.

As mentioned, methods of the invention may include using one or more focusing elements to enhance the current distribution in the electrolyte. In one example, an inner focusing cylinder, and an outer focusing cylinder are used to channel the current in the electrolyte for each of the inner and outer anodes, respectively, to the inner and outer regions, respectively. The topmost portion of the focusing cylinders (an open end) creates a "virtual anode," which brings the current provided within insulative walls of the cylinders proximate to the plating surface of the work piece. The current provided by an individual (actual) anode is not only channeled to an area proximate the work piece, but also can be concentrated to a smaller area than the work surface area of the anode (smaller virtual anode than actual anode providing the current).

If focusing cylinders are used, preferably the topmost apertures of each of the inner and outer focusing cylinders are between about 0.5 and 1.5 inches from the surface of the wafer during electroplating, more preferably about 1 inch from the surface of the wafer during electroplating. Preferably the distance between the topmost portion of the inner focusing cylinder and the wafer is between about four and ten times the thickness of the inner focusing cylinder walls. Preferably the walls of at least the inner focusing cylinder are between about 0.1 and 0.4 inches thick, more preferably between about 0.1 and 0.25 inches thick.

Current shielding elements are also used in some methods of the invention to enhance plating uniformity. In some methods, preferably a circumferential edge portion of the seed layer is shielded from plating current during electroplating. Preferably the circumferential edge portion includes between about 1 and 10 percent of the entire surface area of the seed layer, more preferably between about 3 and 5 percent of the entire surface area of the seed layer. Preferably shielding the circumferential edge portion of the seed layer from plating current during electroplating includes use of a perforated shield to obtain a time-averaged shielding of the edge portion via relative movement between the wafer and the perforated shield.

Another aspect of the invention is a plating cell for electroplating a substantially uniform layer of a metal onto a wafer. Such apparatus may be characterized by the following features: (a) a wafer holder, configured such that the wafer or a metal seed layer thereon serves as a cathode in the plating cell, the wafer holder capable of positioning the wafer in a plating bath of the plating cell; (b) an inner anode located within the plating bath, the inner anode having a ring shape, the work surface of the inner anode having a surface area that corresponds to between about 15 and 25 percent of the platable surface area of the wafer; (c) an outer anode having a ring shape, the outer anode concentric with the inner anode, the work surface of the outer anode having a surface area that corresponds to between about 75 and 85 percent of the platable surface area of the wafer; (d) an inner focusing cylinder, between the inner and outer anodes, configured to focus a first portion of a total cell current in an electrolyte passing between the cathode and the inner anode during a plating process; (e) an outer focusing cylinder, housing the outer anode, configured to focus a second portion of the total cell current in the electrolyte passing between the cathode and the outer anode during the plating process; and (e) a circuit for independently adjusting the first and second portions of the total cell current supplied to each of the inner and outer anodes.

Focusing cylinders of the invention preferably include an insulating material that is chemically compatible with the electrolyte. For example they can be made wholly of such material or be made of a non-insulative material that is coated with an insulative material. Suitable insulating materials for the focusing cylinders include at least one of plastic, nanoporous ceramic, and glass. Preferably the walls of focusing cylinders of the invention between about 0.1 and 0.4 inches thick, more preferably between about 0.1 and 0.25 inches thick. In some examples, the walls of a vessel, such as an anode chamber, serve as an outermost focusing cylinder for an anode or anodes therein. In such cases only the inner surface of the vessel serve as a barrier element to direct current, and therefore the thickness of the vessel walls need not fall within the above parameters to fall within the scope of the invention.

The topmost portion of the inner side of the insulative walls that make up a focusing element of the invention define the outer limits of the area of a corresponding virtual anode. For example, with a focusing cylinder with only an anode therein (no other cylinders therein), the inner diameter of that focusing cylinder at its topmost portion (aperture) defines the area of the virtual anode created for the actual anode within that focusing cylinder. For example, an anode positioned between the walls of two focusing cylinders will have a corresponding ring-shaped (generally) virtual anode defined by the inner diameter of the outer cylinder and the outer diameter of the inner cylinder. Preferably the inner focusing cylinder has an inner diameter at its topmost portion of between about 4 and 5.4 inches, for a 300 mm wafer, more preferably between about 4.1 and 5 inches. Preferably the inner focusing cylinder has an inner diameter at its topmost portion of between about 2.5 and 3.6 inches, for a 200 mm wafer. Preferably the outer focusing cylinder has an inner diameter at its topmost portion of approximately the diameter of the wafer.

Preferably the work surface areas of the virtual anodes of the invention substantially correspond to the work surface of the seed layer on which metal is deposited. For example, for a plating cell of the invention having an inner and an outer virtual anode, the combined surface areas of the first and second virtual anodes is substantially equal the surface area of the seed layer on the workpiece.

Preferably, plating cells of the invention further include a shielding element configured to shield a circumferential edge portion of the wafer from plating current during electroplating. Such shielding elements include, for example, a perforated ring shield proximate to the topmost portion of the outer focusing cylinder and/or a shielding element associated with the wafer holder. Preferably such a perforated ring shield includes an outer diameter substantially equal to the outer diameter of the wafer and an inner diameter of between about 5.3 inches and 7 inches for a 200 mm wafer. For a 300 mm wafer, preferably the perforated ring shield has an outer diameter substantially equal to the outer diameter of the wafer and an inner diameter of between about 8 inches and 11.5 inches, more preferably between about 10 inches and 11 inches for a 300 mm wafer. Preferably the perforated ring shield has a shielding surface area that corresponds to between about 1 and 10 percent of the surface area of the wafer, more preferably between about 3 and 5 percent of the surface area of the wafer.

Plating cells of the invention can include flow flutes configured to distribute the electrolyte flow between the area encompassed by a focusing cylinder, and areas between concentric focusing cylinders. In some plating cells, diffuser membranes are used to create a uniform flow front in the electrolyte that impinges, for example, on the work surface of a wafer.

These and other features and advantages of the present invention will be described in more detail below with reference to the associated drawings.

DETAILED DESCRIPTION OF THE PREFERRED EMBODIMENTS

Figure 1:
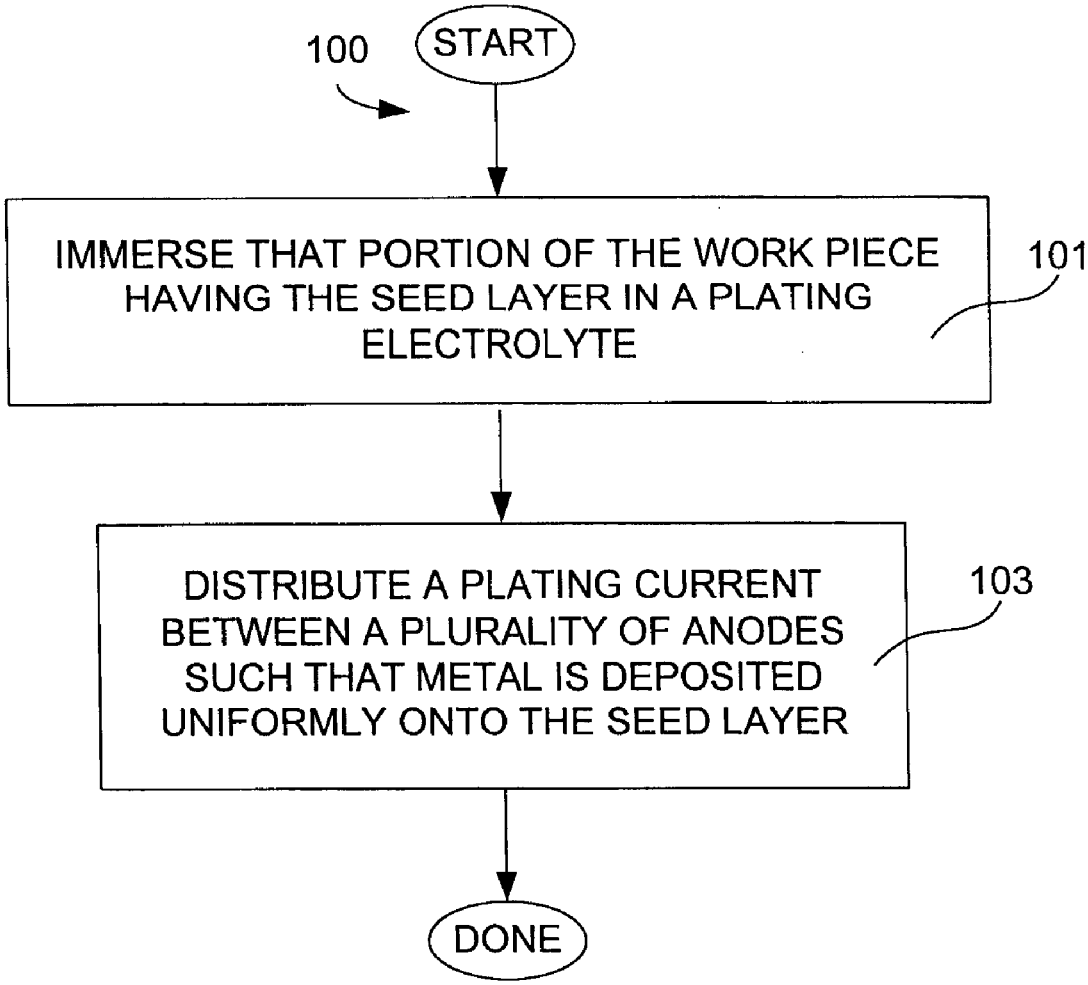
FIG. 1 is a flowchart depicting aspects of a method in accordance with the invention.

In the following detailed description of the present invention, numerous specific embodiments are set forth in order to provide a thorough understanding of the invention. However, as will be apparent to those skilled in the art, the present invention may be practiced without these specific details or by using alternate elements or processes. For example, the invention is described in terms of electroplating on wafers. However, the work piece is not limited to wafers. The work piece may be of various shapes, sizes, and materials. In addition to semiconductor wafers, other work pieces that may take advantage of this invention include various articles such as printed circuit boards, flat panel displays, and the like. In some instances well-known processes, procedures, and components have not been described in detail so as not to unnecessarily obscure aspects of the present invention. In the description and figures below, some reference numbers are repeated for clarity and consistency where common or similar features are described or depicted.

Definitions

Wafer—The following description identifies a semiconductor wafer as the work piece to be cleaned. The invention is not so limited. In this application, the term "wafer" will be used interchangeably with "wafer substrate", and "substrate." One skilled in the art would understand that these terms could refer to a semiconductor (e.g. silicon) wafer during any of many stages of integrated circuit fabrication thereon.

Wafer Holder—A wafer holder generally describes a component that immobilizes a wafer and has positioning components for moving the wafer, e.g. rotation, immersion, and that has circuitry for applying an electrical potential to the wafer via a conductive layer thereon. An exemplary wafer holder is the Clamshell apparatus available from Novellus Systems, Inc. of San Jose, Calif. A detailed description of the clamshell wafer holder is provided in U.S. patent application Ser. No. 09/927,741, naming Mayer et al., filed Aug. 10, 2001, entitled, "Improved Clamshell Apparatus for Electrochemically Treating Wafers," which is herein incorporated by reference for all purposes.

Seed Layer—A seed layer generally refers to a thin conductive layer on a work piece through which current is passed to effect, for example, electroplating. Preferably seed layers of the invention will be copper layers on wafers, however, the invention is not limited.

Focusing Element—A focusing element is a structure that focuses, contains, segregates, channels, or otherwise directs the current density in an electrolyte arising from a particular anodes interaction with a cathode. For example, a focusing cylinder refers to a substantially cylindrical tube that focuses, contains, segregates, channels, or otherwise directs the current density in a region of an electrolyte within the cylinder between an anode, contained within the cylinder, and the cathode (e.g. a seed layer on a work piece). If a plurality of concentric focusing cylinders are used in conjunction with concentric (or other) anode structures, then the innermost focusing cylinder focuses, contains, segregates, and otherwise directs the current density in a region of the electrolyte within it and between an anode, also contained within it, and the cathode. Each remaining focusing cylinder, of the plurality of concentric focusing cylinders, focuses, contains, segregates, channels, or otherwise directs the current density in a region of the electrolyte inside of that cylinder's inner surface, outside the surface of the next nearest cylinder located inside of it, and between an anode contained within that cylinder and the cathode. In the latter case, an anode contained within the cylinder is located between the walls of two adjacent focusing cylinders. Generally, this means that concentric anodes are segregated by the walls of focusing cylinders therebetween.

Virtual anode—A virtual anode refers to the aperture of a focusing element, e.g. a focusing cylinder, through which current from an actual anode passes before reaching a cathode. For a focusing cylinder, the virtual anode work surface area is defined by the inner walls of the topmost portion (an open end) of such a tube through which current passes before reaching the cathode. If an anode is between an inner and an outer focusing cylinder, then its corresponding virtual anode has a ring-shaped structure, the area of which is defined by the inner diameter of the outer cylinder and the outer diameter of the inner cylinder. In this application the area spanned by the virtual anode is termed the "work surface area" of the virtual anode. When a focusing element is used with an anode, the plating current in the electrolyte induced between the anode and a cathode of a plating cell must pass through the work surface area (i.e. an aperture) of the corresponding virtual anode produced by the focusing element. Generally, virtual anodes of the invention are of fixed area, that is, the focusing cylinder apertures are not dynamically controlled (e.g. an iris). However, such apparatus are not outside of the scope of the invention. A detailed description of focusing elements used in conjunction with shielding elements is described in U.S. patent application Ser. No. 10/116,077, having Steve Mayer et al. as inventors, filed Apr. 4, 2002, and titled "Electrochemic Treatment of Integrated Circuit Substrates Using Concentric Anodes and Variable Field Shaping Elements," which is incorporated herein by reference for all purposes.

Scope and Description

As mentioned, this invention is described below in relation to electroplating methods and apparatus for use in integrated circuit (IC) fabrication. In this aspect, the invention provides a simple, low cost, reliable method for the production of uniform electroplated films on very thin metal seeded wafers for integrated circuit fabrication, yielding improvements over the capabilities of current technology. This invention provides excellent uniformity control and improved electrofilling quality of wafers having thinner seed layers, larger diameters (e.g. 300 mm), higher feature densities, and smaller feature sizes.

The invention generally relates to plating tools and processes in which electrical contact is made in the edge region of the wafer substrate. One example is the SABRE™ clamshell electroplating apparatus available from Novellus Systems, Inc. of San Jose, Calif. and described in U.S. Pat. Nos. 6,156,167, 6,159,354, 6,193,859, and 6,139,712, which are herein incorporated by reference in their entirety. The clamshell wafer holder provides many advantages for wafer throughput and uniformity; most notably, wafer back-side protection from contamination during electroplating, wafer rotation during the electroplating process, and a relatively small footprint for wafer delivery to the electroplating bath (vertical immersion path). In the latest versions of the clamshell, the amount of platable surface area on the front work surface of the wafer is maximized by making contact with the wafer at the edge, while using materials that maintain back side protection. This is described in U.S. patent application Ser. No. 10/010,954, entitled "Improved Clamshell Apparatus with Dynamic Uniformity Control," which is herein incorporated by reference in its entirety.

As mentioned, the invention pertains to methods and apparatus for electroplating a substantially uniform layer of a metal onto a work piece having a seed layer thereon. The current of a plating cell is distributed among a plurality of anodes in the plating cell in order to tailor the current distribution in the plating electrolyte to compensate for resistance and voltage variation across a work piece due to the seed layer. In some embodiments, focusing elements are used to create "virtual anodes" in proximity to the plating surface of the work piece to further control the current distribution in the electrolyte during plating.

Generally a resistance profile across a workpiece is assessed. For example, it is known that for semiconductor wafers having thin (e.g. 250–1000 Å) seed layers thereon, when a plating current is applied at the periphery of the seed layer, the inner region of the wafer displays higher resistance to current flow than the outer region (nearer to where contact is made to apply the plating current). Other workpiece (and electrical current supply contact scenarios) seed layers may have different resistance profiles, the invention also applies to other such cases. A plurality of anodes are configured such that varying fractions of a total current for a plating cell can be distributed between the anodes. Also the anodes are configured in proximity to the seed layer on the workpiece so that the current density in a plating electrolyte resulting from the current applied to a particular anode will impinge on a particular region on the seed layer. In this way, the overall current density in the electrolyte is shaped to complement the resistance profile irregularities in the seed layer, and thus uniform plating is achieved. As the plated layer thickens, the resistance profile in the layer will change, and therefore the potential applied to each of the anodes is adjusted to maintain uniform plating throughout a plating process.

FIG. 1 shows an exemplary method, 100, for electroplating a substantially uniform layer of a metal onto a work piece having a seed layer thereon. At least that portion of the work piece having the seed layer thereon is immersed in an electrolyte containing ions of the metal. See 101. A plating current is distributed between a plurality of anodes so that, during electroplating, the metal is deposited uniformly onto the seed layer. See 103. Preferably the metal is continuously deposited onto the surface area of the seed layer exposed to the electrolyte during plating. After a uniform metal layer of desired thickness is plating onto the workpiece, the method is done.

In this invention, the "entire surface area of the seed layer" is the entire platable (exposed) portion of the seed layer (i.e the entire portion not protected by a sealing element, e.g. wafer backside or front edge protection). For this invention, at no time during plating is there a portion of the entire seed layer that is not plated while another portion is plated. The described scenario does not exclude methods where the plating current is pulsed, that is, whenever plating is actually occuring on the seed layer, the entire surface area of the seed layer is plated upon.

Figure 3:
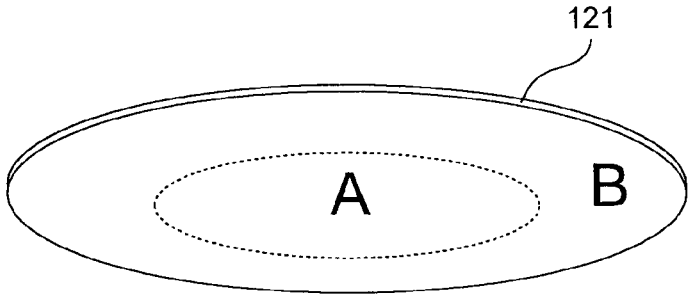
FIG. 3 is a perspective showing inner and outer regions of the surface area of a seed layer on a wafer in accordance with the invention.

As mentioned, semiconductor wafers are exemplary workpieces for methods and apparatus of the invention. Again, when peripheral electrical contact (substantially around the entire periphery) is made with a seed layer on a wafer, generally the entire surface area of the seed layer consists of an inner and an outer region with respect to electrical resistance profiles. FIG. 3, depicts a wafer 121. The frontside of wafer 121 has a seed layer thereon. Since only a small annular peripheral region of the seed layer is not plated upon (e.g. using the Clamshell apparatus as described above for frontside edge exclusion) the entire surface area of the seed layer can be divided into two regions, inner region A and outer region B. In this example, inner region A is a circular surface area, the center of the circular surface area is coincident with the center of wafer 121. Outer region B is an annular surface area defined by an outer circle, substantially coincident with the outermost edge of the wafer, and an inner circle of the same diameter as inner region B. Preferably, the inner region includes between about 15 and 25 percent of the surface area of the seed layer exposed to the electrolyte, the outer region covering the remainder of the surface area of the seed layer exposed to electrolyte.

Figure 2:
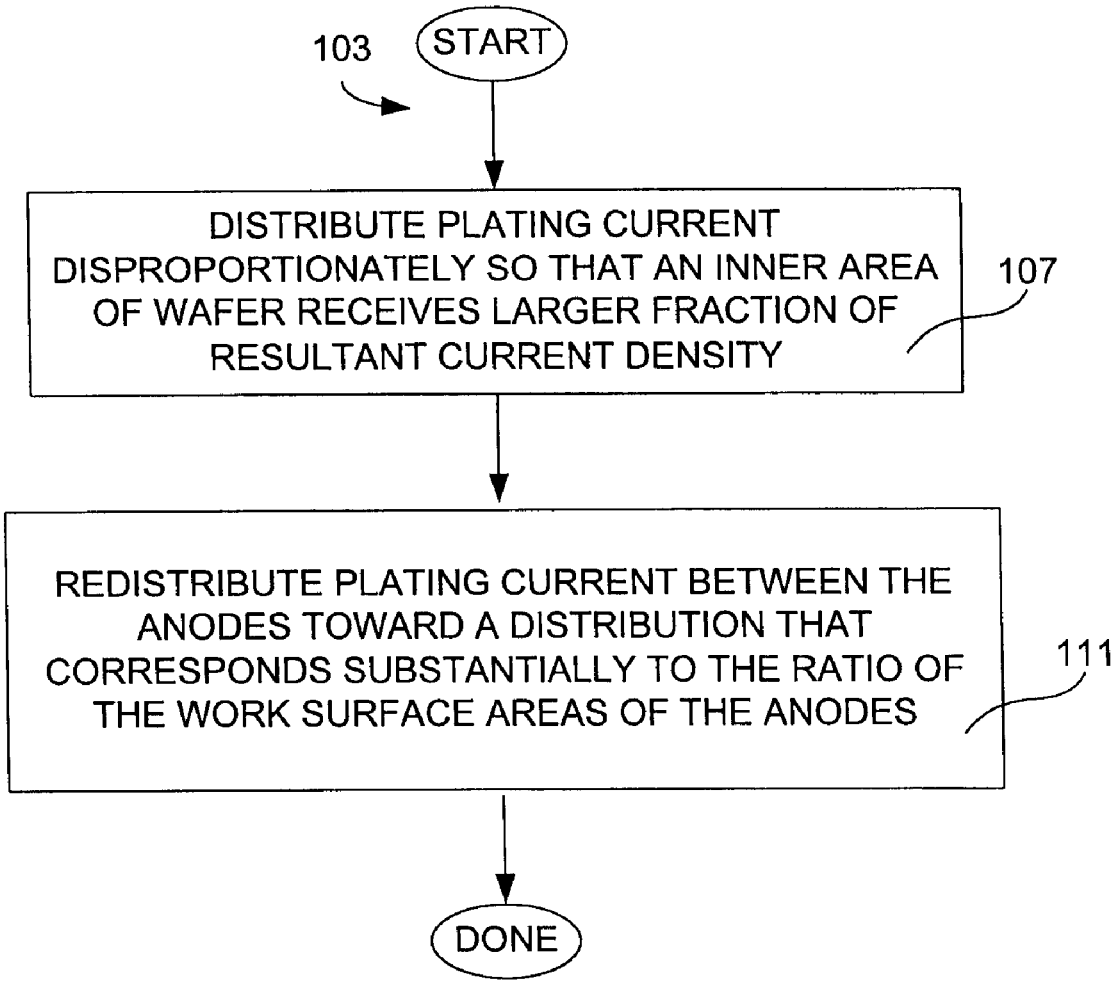
FIG. 2 is a flowchart depicting aspects of a method in accordance with the invention.

FIG. 2 depicts aspects of block 103 (from method 100, see FIG. 1) showing an example of how a current can be distributed between a plurality of anodes so that metal is deposited uniformly onto, for example wafer 121. Initially, compensating for the terminal effect when the seed layer is thin, the current is distributed disproportionately so that inner area A of the wafer receives a larger fraction of the current in the electrolyte resulting from the potential applied to an anode (or anodes) proximate to the inner region. See 107. As the plated layer thickens and the terminal effect lessens, the plating current is redistributed between the anodes toward a distribution that corresponds substantially to the work surface areas of the anodes (when those surface areas correspond to the surface area of the seed layer). That is, the current is distributed among the plurality of anodes during plating to compensate for any resistance profile irregularities arising from the seed layer. In this way, the current density in the electrolyte is tailored to provide uniform plating onto the seed layer despite resistance irregularities in the seed layer. See 111. If focusing cylinders are used, then, in block 111, the plating current is redistributed between the anodes toward a distribution that corresponds substantially to the work surface areas of the virtual anodes. For example, the actual anodes of the invention may be irregular or have large surface areas (such as a porous anode) but focusing cylinders of the invention provide a way to create uniform virtual anodes from any shape actual anode. Once a metal layer of sufficient thickness is obtained, the method is done.

Figure 4:
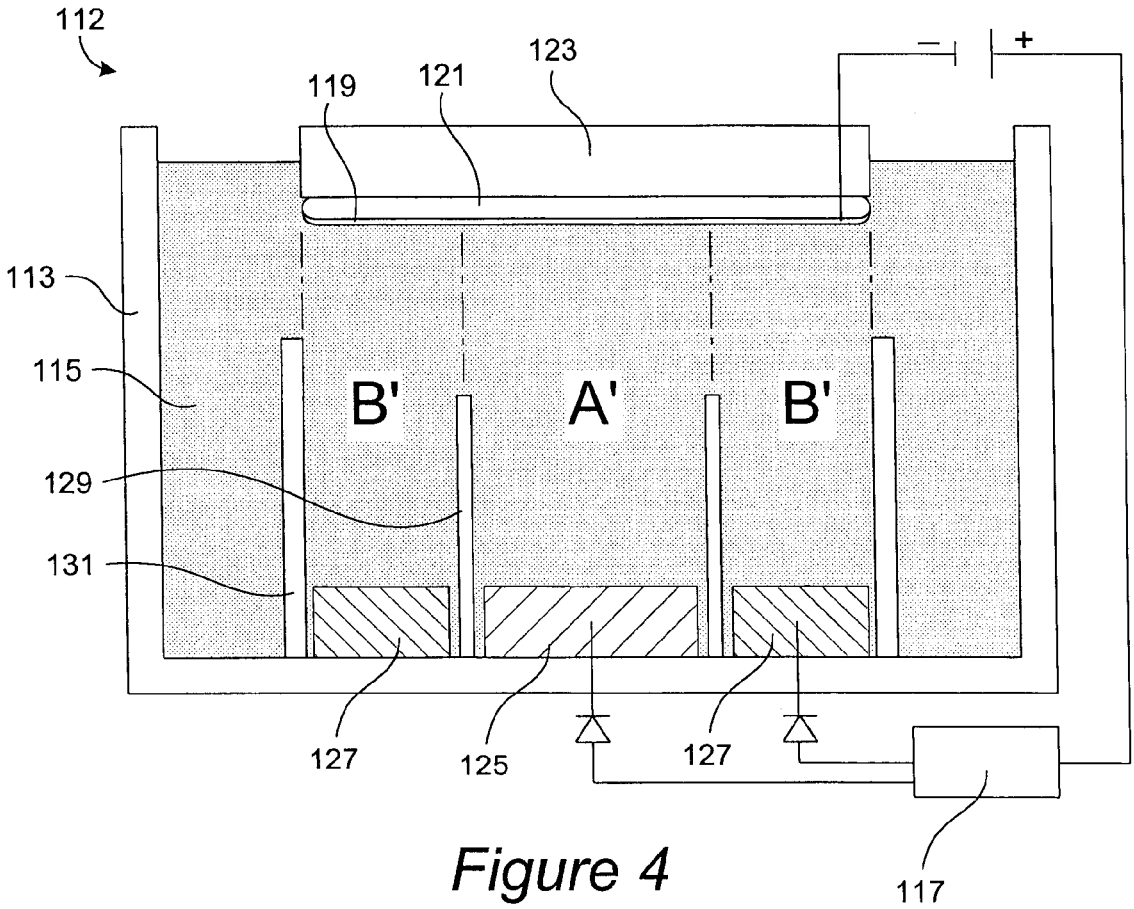
FIG. 4 is a cross-section depicting a plating cell of the invention.
Figure 5:
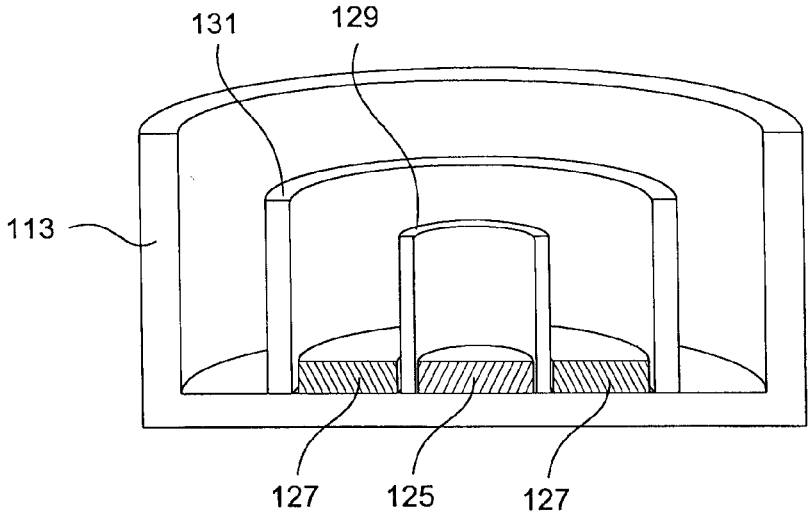
FIG. 5 is a cross-sectional perspective of an arrangement of anodes and focusing cylinders in accordance with the invention.

FIG. 4 is a simplified cross-section of a plating cell, 112, of the invention. Plating cell 112 has a vessel 113, for holding electrolyte 115 (preferably containing copper ions for plating copper onto a seed layer). Wafer holder 123 holds wafer 121, which has a seed layer 119 thereon. Preferably seed layer 119 is a copper seed layer. Circuit 117 distributes the plating current variably to each of two anodes, 125 and 127. In one example, such a circuit employs diodes to ensure unidirectional current flow and lessen cross communication in the cell with respect to the anodes. In this example, inner anode 125 is a disk and outer anode 127 is a ring-shaped anode (preferably anodes of the invention are made of high purity copper). Refer also to FIG. 5. Preferably the work surface of the inner anode has a surface area that corresponds to between about 15 and 25 percent of the platable surface area of the wafer to be plated. Preferably the work surface of the outer anode has a surface area that corresponds to between about 75 and 85 percent of the platable surface area of the wafer to be plated.

In this example, anodes 125 and 127 are positioned in the bottom of vessel 113 such that there is sufficient space for focusing cylinders 129 and 131. Focusing elements such as cylinders are particularly effective in aiding methods of shaping current density in the electrolyte. The "virtual anodes" created by such focusing elements are "virtual" current sources, in this case at the cylinder opening, which are mathematically and physically similar to the situation of having an actual anode located at the virtual anode locations. Therefore, one can obtain the benefits of having an anode at a particular location, without having to actually position the anode there.

Preferably focusing cylinders of the invention are made, at least in part, of insulative materials. Preferred insulative materials include at least one of plastic, nanoporous ceramic, and glass.

Inner focusing cylinder 129 is used to focus current in electrolyte 115 arising from closure of the cell circuit between the cathode (seed layer 119) and inner anode 125 (region A' in the electrolyte). Region A' is a cylindrical space spanning the distance between the work surface of inner anode 125 and seed layer 119 (see FIG. 5 for reference). The inner diameter of the topmost portion of inner focusing cylinder 129 defines the area of a circular opening that is the virtual anode for anode 125. Preferably the inner focusing cylinder has an inner diameter at its topmost portion (aperture) of between about 4 and 5.4 inches for a 300 mm wafer, more preferably between about 4.1 and 5 inches. For a 200 mm wafer, preferably the inner focusing cylinder has an inner diameter at its topmost portion (aperture) of between about 2.5 and 3.6 inches. Thus the area of a cross section of region A' in the electrolyte approximately corresponds to the area of inner region A on the wafer surface (see FIG. 3) depending, for example, on the distance between the inner virtual anode and seed layer 119.

Wafer holder 123 is capable of positioning wafer 121 in close proximity to the topmost portion of the inner focusing cylinder. Preferably the distance between the topmost portion of the inner focusing cylinder and the wafer is between about 0.5 and 1.5 inches during plating, more preferably about 1 inch. Put another way, preferably the distance between the topmost portion of the inner focusing cylinder and the wafer is between about four and ten times the thickness of the inner focusing cylinder walls during plating. Preferably the walls of at least the inner focusing cylinder are between about 0.1 and 0.4 inches thick, more preferably between about 0.1 and 0.25 inches thick.

Outer focusing cylinder 131 is used (in conjunction with cylinder 129) to focus current in electrolyte 115 arising from closure of the cell circuit between the cathode (seed layer 119) and outer anode 127 (region B' in the electrolyte). Region B' is a cylindrical space spanning the distance between the work surface of outer anode 127 and seed layer 119 (minus the space encompassed by region A' and inner focusing cylinder 129, see FIG. 5 for reference). The inner diameter of the topmost portion of outer focusing cylinder 131 and the outer diameter of inner focusing cylinder 129 define the area of an annular opening that is the virtual anode for anode 127. Preferably the outer focusing cylinder has an inner diameter at its topmost portion (aperture) that approximates the diameter of the wafer being plated. Thus the area of a cross section of region B' in the electrolyte approximately corresponds to the area of outer region B on the wafer surface (see FIG. 3) depending, for example, on the distance between the outer virtual anode and seed layer 119.

Figure 6:
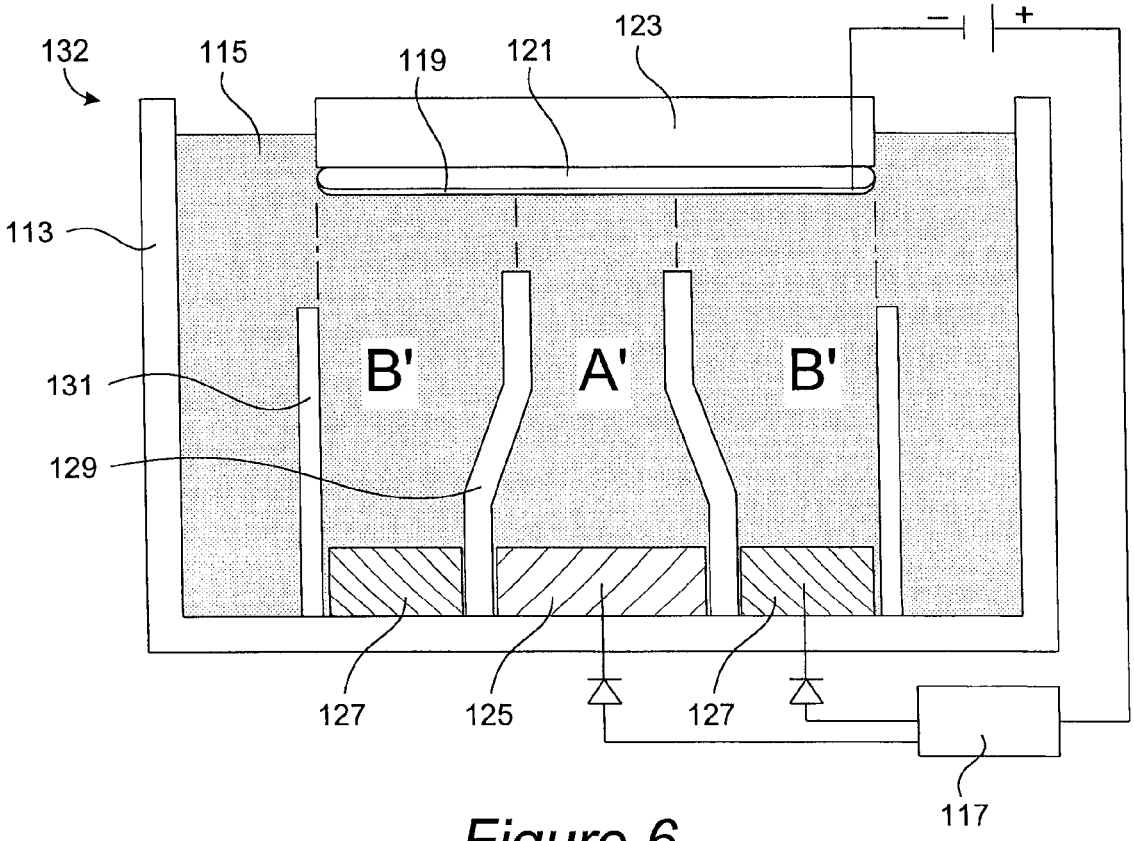
FIG. 6 is a cross-section depicting another plating cell of the invention.

In this example, the inner focusing cylinder and outer focusing cylinder are of different height, that is, their topmost portions (which define the virtual anodes as described above) are different distances away from the seed layer during plating. Also they have walls of different thickness. This is only one example. The height of the inner and outer focusing cylinders and their respective wall thicknesses can be the same. FIG. 6, shows another preferred embodiment where inner focusing cylinder 129 has thicker walls than outer focusing cylinder 131 and has a topmost portion which is closer to the wafer than the outer focusing cylinder. In the example of FIG. 6, the walls of inner focusing cylinder 129 taper inward from bottom to top to focus the current in region A' in proximity to wafer 121. In this case, the virtual anode corresponding to inner anode 125 has a work surface area that is smaller than the work surface area of inner anode 125. When focusing cylinders are used, generally the current is distributed between the inner and outer anodes as a function of the desired current density emanating from or passing through their corresponding virtual anodes.

Referring to FIGS. 4 and 6, generally, but not necessarily, the inner focusing cylinder is a right cylinder, however depending on desired wafer positioning or other factors the inner focusing cylinder might be for example an oblique or other cylinder. Also, since the heights of the inner and the outer focusing cylinders are different, then the outer "virtual anode" surface area is tilted with respect to the plane of the wafer (while the inner virtual anode surface area is parallel to the same plane). For the purposes of this application, the virtual anode surface areas are considered as if they have substantially the area as cross sections (parallel to wafer work surface) of the region A' or B' at the height of the aperture of the focusing cylinder in question. For example, in FIG. 6, the virtual anode surface area for inner focusing cylinder 129 is the surface area of a circle defined by the inner diameter of cylinder 129 at its aperture (proximate seed layer 119). The virtual anode surface area for outer focusing cylinder 131 is substantially the same as the area of a cross section through region B' at the height of the aperture (proximate seed layer 119) of outer cylinder 131. Although it is noted that by varying the height of their respective focusing cylinders, the focusing effect for each of the virtual anodes is relative to having the cylinders at equal height.

In the examples described in relation to FIGS. 3–6, distributing a plating current between a plurality of anodes means distributing the current between an inner anode, proximate to the inner region, and an outer anode, proximate to the outer region. Thus in accordance with the description above, when electroplating metal onto a wafer with a thin seed layer (where electrical contact is made at the wafer edge), the current is distributed between the inner and outer anode to compensate for the terminal effect. For example, a larger percentage of the total anodic potential of a cell is applied to the inner anode in order to overcome initial higher electrical resistance levels in the inner region (vs. in the outer region). As the plated layer thickens, the terminal effect is diminished, so the relative ratio of current applied to the inner vs. the outer anode is decreased in order to more evenly distribute the electrical current density in the electrolyte proximate the inner vs. outer regions. The focusing cylinders described, not only direct the current densities of their respective anodes to desired areas in the electrolyte proximate to the seed layer, but due to their insulative properties, they segregate the respective current densities so that they do not mix. This allows for better control of the plating environment, particularly current density shaping.

Figure 7:
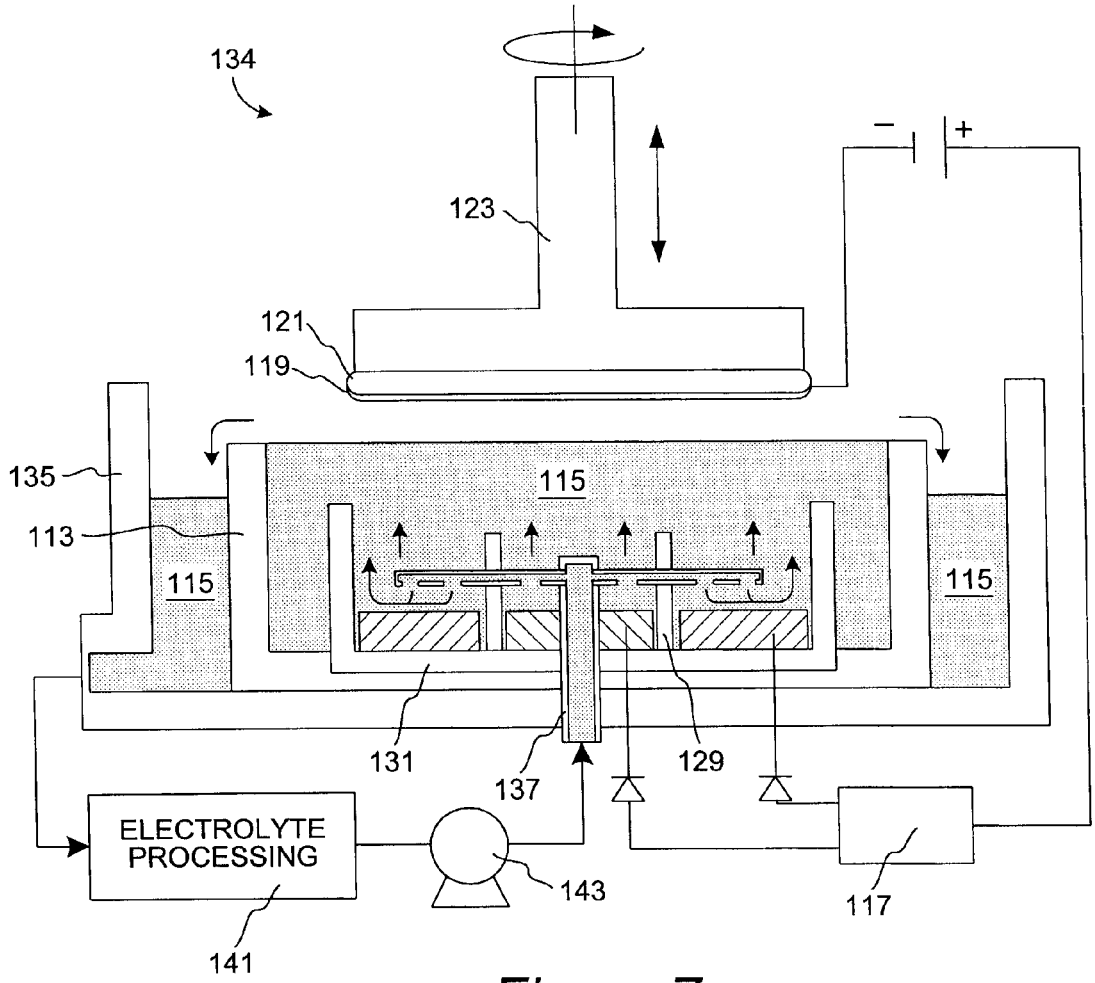
FIG. 7 is a cross-section depicting yet another plating cell of the invention.

FIG. 7 depicts a plating cell, 134, of the invention. This depiction shows more detail than previous figures. Plating cell 134 has many of the features of the plating cells described in relation to FIGS. 4 and 6. In this example, wafer holder 123 provides positioning and movement to wafer 121 consistent with the clamshell apparatus as described above (wafer depicted pre-immersion into electrolyte 115). During plating the wafer is typically rotated to aide in achieving uniform deposition, for example. In plating cell 134, inner focusing cylinder 129 is inside a cup-shaped vessel 131, this vessel is generally referred to as an anode chamber. The side wall of anode chamber 131 serve as the outer focusing cylinder in this case. The inner diameter of vessel 131 is approximately equal to the diameter of the wafer.

Electrolyte 115 enters anode chamber 131 via inlet 137. In this case inner and outer anodes 125 and 127 both have ring shapes. Inlet 137 passes through inner anode 125. Electrolyte 115 travels from the interior of inlet 137 to a plurality of flow flutes 139 (see FIG. 8). Flow flutes 139 each have a plurality of outlet holes along their length for delivering the electrolyte to the anode chamber. Preferably the plurality of holes are positioned on a surface of each of the plurality of flow flutes that faces the work surfaces of the inner and outer anodes. Also preferably the plurality of holes direct the electrolyte flow towards the inner and outer anodes such that the flow impinges the inner and outer anode work surfaces at an angle of between about 30 and 60 degrees from horizontal. This helps to provide a preferred uniform laminar flow of the electrolyte which impinges on the wafer work surface (perpendicular to the wafer work surface) during plating. Some of flow flutes 139 pass through the wall of inner focusing cylinder 125 in order to distribute the electrolyte to the area between the outer and inner focusing cylinders. Preferably the total flow of electrolyte impinging on the wafer is between about 3 and 20 liters per minute.

Electrolyte passes over the side walls of anode chamber 131 and into an outer vessel 135. From vessel 135, the electrolyte flows to electrolyte processing apparatus 141. In this case, the electrolyte is replenished and/or reconstituted so that it can be used again for plating. Pump 143 is used to pump the electrolyte into inlet 137 and recirculate the electrolyte through plating cell 134 as described.

By using flow flutes (or equivalent structures) that supply each of the regions A' and B' (refer to FIGS. 4 and 6) inside of the inner focusing cylinder and between the inner and outer focusing cylinders, respectively, another dimension of plating control is realized. That is, rather than a single supply inlet (e.g. inlet 137) for the flow flutes, separate supply lines can be used to supply different electrolyte compositions to each of the aforementioned areas. In this way, current densities can further be controlled. As well, flow rates can be varied between each of the aforementioned regions. As mentioned however, it is preferable to use a single electrolyte composition and a uniform electrolyte flow rate, while tailoring the current density characteristics of the electrolyte via distribution of cell current between a plurality of anodes as described.

Figure 8:
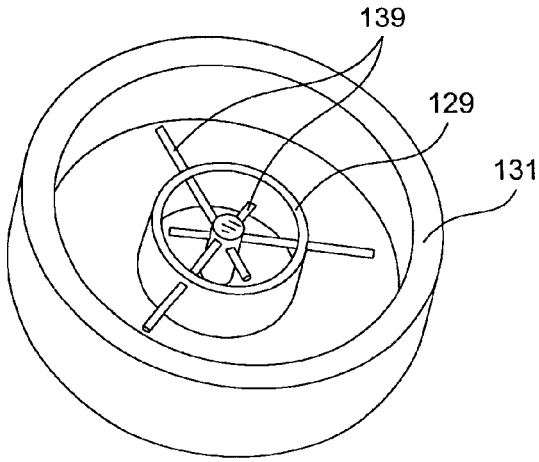
FIG. 8 is a perspective of an anode chamber in accordance with the invention.
Figure 9:
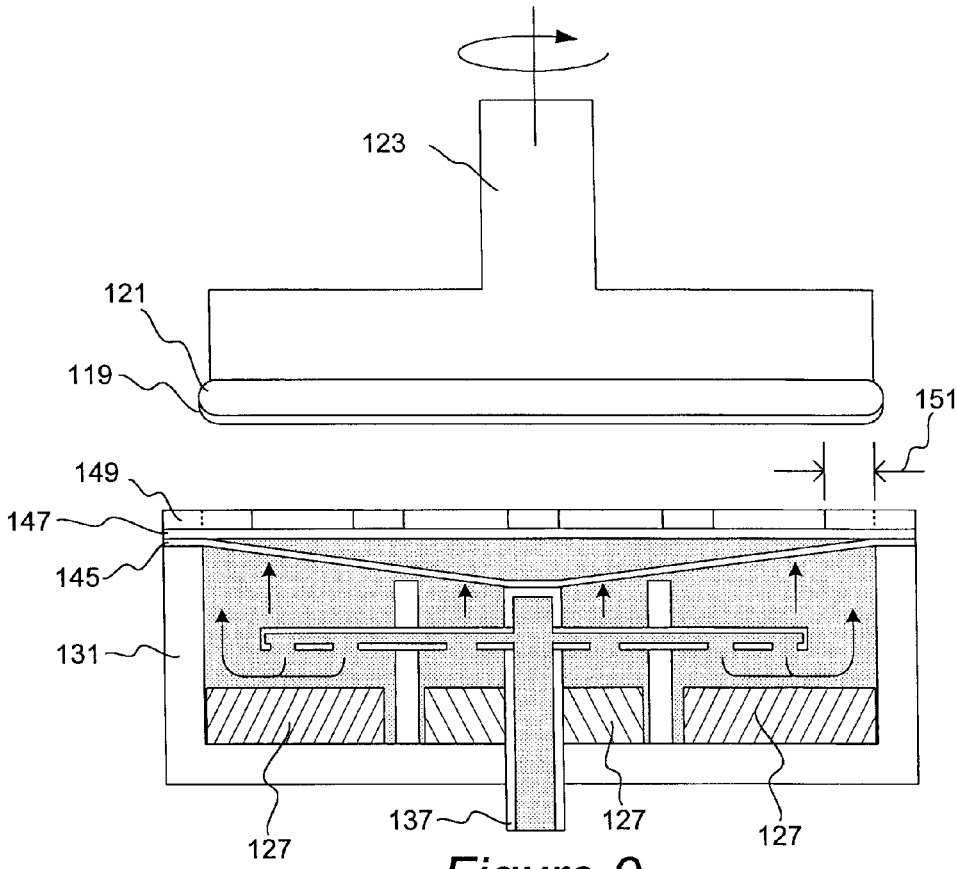
FIG. 9 is a cross-section depicting a preferred anode chamber assembly in accordance with the invention.

FIG. 9 depicts an even more preferred anode chamber assembly in accordance with embodiments described for FIG. 8. In this case, there are additional elements added to the anode chamber. A transport membrane, 145, is included for segregation of impurities from the electrolyte that has undergone interaction with the cathode during plating with the electrolyte that has only contacted the anodes within the anode chamber. A diffuser membrane, 147, is included for helping to provide a uniform laminar flow (via a differential pressure established on either side of the diffuser membrane) of the electrolyte which impinges on the wafer. A detailed description of membranes 145 and 147 is given in U.S. patent application Ser. No. 09/927,740, naming Reid et al., filed Aug. 10, 2001, entitled, "Methods and Apparatus for Controlling Electrolyte Flow for Uniform Plating," which is herein incorporated by reference for all purposes.

Figure 10:
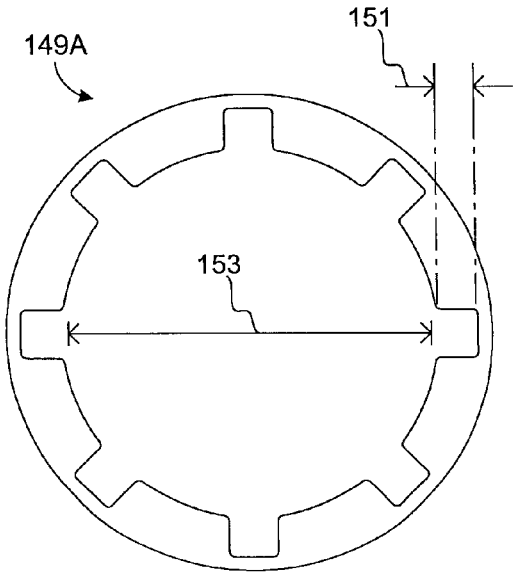
FIGS. 10–11 depict top views of perforated shielding rings in accordance with the invention.
Figure 11:
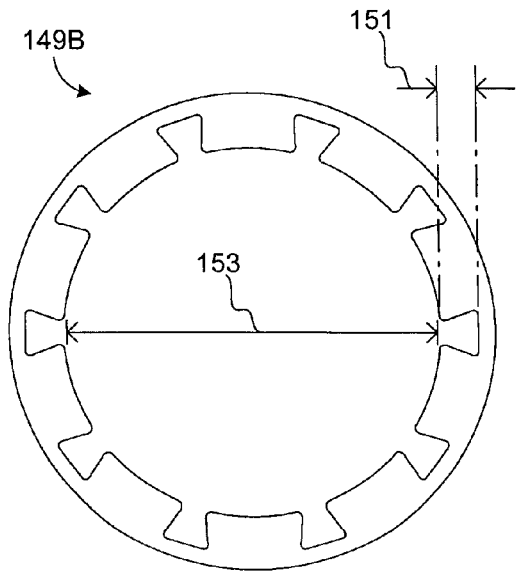

In addition to membranes 145 and 147, a perforated ring shield, 149, is included with anode chamber 131 (sometimes the perforated ring shield is referred to as a "diffuser shield because in some examples it is located atop diffuser membrane, 147). In some cases, it is desirable to shield a circumferential edge (annular) portion of the seed layer from plating current during electroplating in conjunction with current shaping methods as described above. Preferably the circumferential edge portion includes between about 1 and 10 percent of the area of the seed layer, more preferably between about 3 and 5 percent of the area of the seed layer. In this example, shielding the circumferential edge portion of the outer region from plating current during electroplating is achieved with perforated ring shield 149. Distance 151 substantially corresponds to the width of the circumferential edge portion of the wafer that is desirable to shield from plating current. FIGS. 10 and 11 show top views of exemplary perforated ring shields of the invention. Perforated ring shields 149A and 149B provide a time-averaged shielding of the circumferential edge portion via relative movement between the wafer and the perforated shield during electroplating. Preferably the perforated ring shield has an outer diameter substantially equal to the outer diameter of the wafer and an inner diameter, 153, of between about 5.3 and 7 inches for a 200 mm wafer, an inner diameter of between about 8 and 11.5 inches for a 300 mm wafer, more preferably between about 10 and 11 inches.

The size, shape, location, and number of perforations in the ring shields determine the shielding surface area that corresponds to the surface area of the wafer that is shielded during plating. In FIGS. 10 and 11, the ring shield perforations are open (on inner periphery of shield) slots of rectangular and wedge shapes, respectively.

In some cases, the circumferential edge portion of the wafer can be shielded using a shielding element on the wafer holder. This can be alone or in conjunction with the perforated ring shield described above. A particularly useful edge shielding element that is part of a wafer holder is the cup insert apparatus of the clamshell wafer holder. A detailed description of the cup insert and clamshell wafer holder is provided in U.S. patent application Ser. No. 09/927,741, naming Mayer et al., filed Aug. 10, 2001, entitled, "Improved Clamshell Apparatus for Electrochemically Treating Wafers," which is herein incorporated by reference for all purposes.

Experimental

Figure 12:
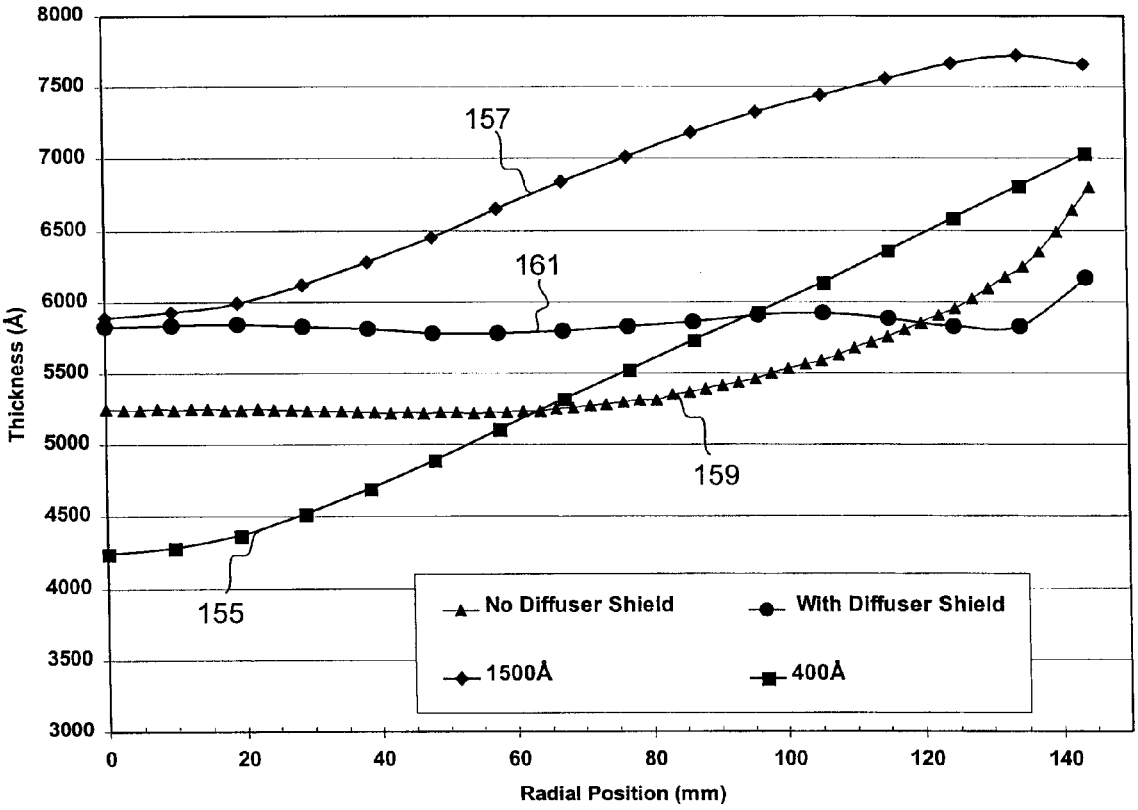
FIG. 12 is a graph showing how the invention provides uniform electrodeposition of metal layers on a 300 mm wafer.

Using methods and apparatus of the invention (particularly as described in relation to FIGS. 9–11), copper was plated onto 300 mm wafers having seed layers of between 400 Å and 1500 Å thick. FIG. 12 is a graph depicting the effectiveness of using a perforated ring shield in conjunction with current shaping methods as described above. For baseline comparison, lines 155 and 157 show the final thickness of a plated layer on a 300 mm wafer having 400 Å and 1500 Å seed layers, respectively. This data indicates that due to the terminal effect, the resultant layers are much thicker in the outer annular region of a 300 mm wafer than in the inner region. By distributing anodic potential to an anode proximate to the inner region of the wafer (in conjunction with a focusing cylinder) initially and then moving towards a distribution that reflects the surface area of the anodes (or virtual anodes) used, the uniformity of the layer is greatly increased. See line 159. By adding a perforated ring shield (sometimes called a "diffuser shield" since it may be part of an anode chamber diffuser membrane assembly) to provide time-averaged shielding of a circumferential edge region of the wafer, the uniformity is further increased. See line 161.

Preferred methods of the invention use electrolyte baths of varying acid content. Two particularly useful formulations are those with high and low acid content. Below are described a few preferred methods which use apparatus as described above to plate copper onto 300 mm wafers (having seed layers between about 250 Å and 1000 Å thick). The following parameters outlined below are consistent for use with an apparatus such as that described in relation to FIGS. 7 and 9, more particularly FIG. 9. That is, an apparatus having an inner and outer anode, with corresponding focusing cylinders for each anode. The dimensions, relevant positioning, and surface areas of the anodes and their corresponding virtual anodes preferably fall within the preferred parameters described above. The resultant copper layers deposited on the wafers have uniformities consistent with the data in FIG. 12 (specifically line 161).

Example 1

High Acid Electrolyte Bath

A preferred "high acid bath" electrolyte formulation contains, among other things, about 176 g/l of sulfuric acid and about 17.4 g/l of copper sulfate. Such formulations are considered relatively low resistance electrolytes, having a typical conductivity of about 600 mS/cm.

When using such an electrolyte for plating on a 300 mm wafer having a seed layer between about 250 Å and 1000 Å thick, an exemplary set of preferred plating parameters to achieve results as described above are:

High Acid Bath Plating

| Step | Anodic Current | Ratio of Current Inner/Outer Anode | Time (seconds) |
|---|---|---|---|
| 1 | between about 1 and 2 amps | between about 80:20 and 100:0 | between about 10 and 30 s |
| 2 | between about 5 and 8 amps | between about 80:20 and 100:0 | between about 10 and 30 s |
| 3 | between about 15 and 20 amps | between about 25:75 and 15:85 | between about 15 and 25 s |
| 4 | between about 30 and 35 amps | between about 25:75 and 15:85 | between about 15 and 20 s |

Example 2

Low Acid Electrolyte Bath

A preferred "low acid bath" electrolyte formulation contains, among other things, about 10 g/l of sulfuric acid and about 40 g/l of copper sulfate. Such formulations are considered relatively high resistance electrolytes, having a typical conductivity of about 60 mS/cm.

When using such an electrolyte for plating on a 300 mm wafer having a seed layer between about 250 Å and 1000 Å thick, an exemplary set of preferred plating parameters to achieve results as described above are:

Low Acid Bath Plating

| Step | Anodic Current | Ratio of Current Inner/Outer Anode | Time (seconds) |
|---|---|---|---|
| 1 | between about 2 and 5 amps | between about 20:80 and 40:60 | between about 10 and 20 s |
| 2 | between about 5 and 8 amps | between about 25:75 and 40:60 | between about 10 and 30 s |
| 3 | between about 15 and 20 amps | between about 15:85 and 25:75 | between about 15 and 25 s |
| 4 | between about 30 and 35 amps | between about 15:85 and 25:75 | between about 15 and 20 s |

In the low acid bath case, the highly resistive nature of the bath ameliorates the terminal effect, but distributing the anodic potential between a plurality of anodes is still useful in tailoring the current density for optimum plating uniformity.

Although various details have been omitted for clarity's sake, various design alternatives may be implemented. Therefore, the present examples are to be considered as illustrative and not restrictive, and the invention is not to be limited to the details given herein, but may be modified within the scope of the appended claims.

What is claimed is:

1. A method for electroplating a substantially uniform layer of a metal onto a work piece having a seed layer thereon, the method comprising:

(a) immersing at least that portion of the work piece having the seed layer thereon in an electrolyte, said electrolyte containing ions of the metal; and (b) passing a current between the seed layer and a plurality of anodes whereby the current is distributed among the plurality of anodes such that, for any instance in time during plating, the metal is deposited substantially uniformly onto the entire surface area of the seed layer.

2. The method of claim 1, wherein the work piece is a wafer and the seed layer covers the front side work surface of the wafer.

3. The method of claim 2, wherein the entire surface area of the seed layer consists of an inner and an outer region, said inner region comprising a circular surface area, the center of said circular surface area coincident with the center of the wafer, said outer region comprising an annular surface area defamed by an outer circle, substantially coincident with the outermost edge of the wafer, and an inner circle of the same diameter as the inner region.

4. The method of claim 3, wherein (b) comprises distributing the current between an inner anode, proximate to the inner region, and an outer anode, proximate to the outer region.

5. The method of claim 4, wherein the inner and outer anodes comprise a pair of concentric rings positioned substantially parallel to the wafer, said pair of concentric rings' common center sharing an axis perpendicular to and passing through the center of the wafer, the inner anode's outer diameter being smaller than the inner diameter of the outer anode.

6. The method of claim 5, wherein an inner focusing cylinder, and an outer focusing cylinder are used to channel the current density in the electrolyte during plating for each of the inner and outer anodes, respectively, to the inner and outer regions, respectively.

7. The method of claim 6, wherein the inner region comprises between about 15 and 25 percent of the surface area of the seed layer exposed to the electrolyte, the outer region comprising the remainder of the surface area of the seed layer.

8. The method of claim 6, wherein the topmost apertures of each of the inner and outer focusing cylinders are between about 0.5 and 1.5 inches from the surface of the wafer during electroplating.

9. The method of claim 8, wherein the topmost apertures of each of the inner and outer focusing cylinders are about 1 inch from the surface of the wafer during electroplating.

10. The method of claim 6, wherein the distance between the topmost portion of the inner focusing cylinder and the wafer is between about four and ten times the thickness of the inner focusing cylinder walls.

11. The method of claim 6, wherein the walls of at least the inner focusing cylinder are between about 0.1 and 0.4 inches thick.

12. The method of claim 6, wherein the walls of at least the inner focusing cylinder are between about 0.1 and 0.25 inches thick.

13. The method of claim 6, further comprising shielding a circumferential edge portion of the seed layer from plating current during electroplating.

14. The method of claim 13, wherein the circumferential edge portion comprises between about 1 and 10 percent of the entire surface area of the seed layer.

15. The method of claim 13, wherein the circumferential edge portion comprises between about 3 and 5 percent of the entire surface area of the seed layer.

16. The method of claim 13, wherein shielding the circumferential edge portion of the seed layer from plating current during electroplating comprises use of a perforated shield to obtain a time-averaged shielding of the edge portion via relative movement between the wafer and the perforated shield.

17. The method of claim 1, further comprising providing a substantially uniform laminar flow of the electrolyte which impinges the wafer perpendicular to the wafer's work surface during plating.

18. The method of claim 17, wherein the total flow of electrolyte which impinges on the wafer is between about 3 and 20 liters per minute.

19. The method of claim 2, wherein (b) comprises:

i. distributing the current between a first anode, said first anode proximate an inner region of the seed layer, and a second anode, said second anode proximate an outer region of the seed layer, such that the inner region is exposed to a larger fraction of the resultant current per unit area than the outer region during an initial stage of plating; and ii. redistributing the current between the first and second anodes toward a distribution that corresponds substantially to the ratio of the work surface areas of the first and second anode or work surface areas of any corresponding virtual anodes for each of the first and the second anodes;

wherein the work surface areas of each of the first and second anodes and the work surfaces of said any corresponding virtual anodes for each of the first and the second anodes correspond substantially to the areas of the inner and outer regions of the seed layer, respectively.

20. A plating cell for electroplating a substantially uniform layer of a metal onto a wafer, the plating cell comprising:

(a) a wafer holder, configured such that the wafer or a metal seed layer thereon serves as a cathode in the plating cell, said wafer holder capable of positioning the wafer in a plating bath of the plating cell;

(b) an inner anode located within the plating bath, said inner anode comprising a ring shape, the work surface of said inner anode comprising a surface area that corresponds to between about 15 and 25 percent of the platable surface area of the wafer;

(c) an outer anode, said outer anode comprising a ring shape, said outer anode concentric with the inner anode, the work surface of said outer anode comprising a surface area that corresponds to between about 75 and 85 percent of the platable surface area of the wafer;

(d) an inner focusing cylinder, between the inner and outer anodes, configured to focus a first portion of a total cell current in an electrolyte passing between the cathode and the inner anode during a plating process;

(e) an outer focusing cylinder, housing the outer anode, configured to focus a second portion of the total cell current in the electrolyte passing between the cathode and the outer anode during the plating process; and (e) a circuit for independently adjusting the first and second portions of the total cell current supplied to each of the inner and outer anodes.

21. The plating cell of claim 20, wherein the walls of at least the inner focusing cylinder are between about 0.1 and 0.4 inches thick.

22. The plating cell of claim 20, wherein the walls of at least the inner focusing cylinder are between about 0.1 and 0.25 inches thick.

23. The plating cell of claim 20, wherein the inner and outer focusing cylinders comprise an insulating material that is chemically compatible with the electrolyte.

24. The plating cell of claim 23, wherein the insulating material comprises at least one of plastic, nanoporous ceramic, and glass.

25. The plating cell of claim 20, wherein the inner focusing cylinder has an inner diameter at its topmost portion of between about 4 and 5.4 inches, for a 300 mm wafer.

26. The plating cell of claim 20, wherein the inner focusing cylinder has an inner diameter at its topmost portion of between about 4.1 and 5 inches, for a 300 mm wafer.

27. The plating cell of claim 20, wherein the inner focusing cylinder has an inner diameter at its topmost portion of between about 2.5 and 3.6 inches, for a 200 mm wafer.

28. The plating cell of claim 20, wherein the outer focusing cylinder has an inner diameter at its topmost portion of approximately the diameter of the wafer.

29. The plating cell of claim 20, further comprising a shielding element configured to shield a circumferential edge portion of the wafer from plating current during electroplating.

30. The plating cell of claim 29, wherein the shielding element comprises a perforated ring shield proximate to the topmost portion of the outer focusing cylinder.

31. The plating cell of claim 29, wherein the wafer holder is a clamshell and the shielding element comprises a cup insert.

32. The plating cell of claim 30, wherein the wafer holder is a clamshell and the shielding element comprises a cup insert and the perforated ring shield.

33. The plating cell of claim 20, further comprising an electrolyte inlet, configured to supply a flow of the electrolyte to the plating bath, said electrolyte inlet delivering the electrolyte through substantially the center of the inner anode.

34. The plating cell of claim 33, wherein the electrolyte inlet comprises a plurality of flow flutes.

35. The plating cell of claim 34, wherein the plurality of flow flutes are configured to distribute the flow of the electrolyte between the space encompassed by the inner focusing cylinder, and the space between the inner and outer focusing cylinder.

36. The plating cell of claim 35, wherein the plurality of flow flutes distribute the electrolyte flow via a plurality of holes along each of their lengths.

37. The plating cell of claim 36, wherein the plurality of holes are positioned on a surface of each of the plurality of flow flutes that faces the work surfaces of the inner and outer anodes.

38. The plating cell of claim 37, wherein the plurality of holes direct the electrolyte flow towards the inner and outer anodes such that the flow impinges the inner and outer anode work surfaces at an angle of between about 30 and 60 degrees from horizontal.

39. The plating cell of claim 35, further comprising a diffuser membrane positioned between the topmost portions of each of the inner and outer focusing cylinders and the wafer holder, such that during the plating process, the flow of electrolyte passes through the diffuser membrane before impinging on the wafer.

40. The plating cell of claim 30, wherein the perforated ring shield comprises an outer diameter substantially equal to the outer diameter of the wafer and an inner diameter of between about 5.3 inches and 7 inches for a 200 mm wafer.

41. The plating cell of claim 30, wherein the perforated ring shield has an outer diameter substantially equal to the outer diameter of the wafer and an inner diameter of between about 8 inches and 11.5 inches for a 300 mm wafer.

42. The plating cell of claim 30, wherein the perforated ring shield has an outer diameter substantially equal to the outer diameter of the wafer and an inner diameter of between about 10 inches and 11 inches for a 300 mm wafer.

43. The plating cell of claim 30, wherein the perforated ring shield comprises a shielding surface area that corresponds to between about 1 and 10 percent of the surface area of the wafer.

44. The plating cell of claim 30, wherein the perforated ring shield comprises a shielding surface area that corresponds to between about 3 and 5 percent of the surface area of the wafer.

45. The plating cell of claim 20, wherein the circuit comprises diodes configured to promote unidirectional current flow and reduce cross communication between the inner anode and the outer anode with their respective portions of the cathode in the plating cell during plating.

* * * * *